US006466180B2

(12) United States Patent
Stengel, Jr.

(10) Patent No.: US 6,466,180 B2
(45) Date of Patent: Oct. 15, 2002

(54) MULTIPLE STUB TUNER FOR DISGUISED VEHICLE ANTENNA

(75) Inventor: Francis A. Stengel, Jr., Lancaster, NY (US)

(73) Assignee: STI-CO Industries Inc., Orchard Park ( * ) Notice: Subject to any disclaimer, the term of this patent is extended or adjusted under 35 U.S.C. 154(b) by 0 days.

(21) Appl. No.: 09/822,640

(22) Filed: Mar. 30, 2001

(65) Prior Publication Data

US 2002/0005814 A1 Jan. 17, 2002

Related U.S. Application Data

(60) Provisional application No. 60/193,207, filed on Mar. 30, 2000.

(51) Int. Cl.[7] ..... H01Q 1/50; H01Q 1/320; H01Q 23/000

(52) U.S. Cl. ..... 343/850; 343/713; 11/858

(58) Field of Search ..... 343/850, 852, 343/860, 865, 858, 711, 713, 715, 745, 701, 851

(56) References Cited

U.S. PATENT DOCUMENTS 4,479,130 A * 10/1984 Snyder ..... 343/802
5,289,197 A * 2/1994 Lindenmeier et al. ..... 343/701
5,771,026 A * 6/1998 Stengel, Jr. ..... 343/715

* cited by examiner

*Primary Examiner*—Don Wong
*Assistant Examiner*—Chuc Tran
(74) *Attorney, Agent, or Firm*—Hodgson Russ LLP

(57) ABSTRACT

A matching network for coupling an OEM vehicle antenna to communications equipment operating at two different frequencies without any physical modification of the antenna mast and base. The network comprises a first transmission line section connected at one end to the antenna, a first stub tuner connected to the opposite end of the first transmission line section, a second transmission line section connected at one end to the junction of the first transmission line section and the first stub tuner, a second stub tuner connected to the opposite end of the second transmission line section, and a feedline connected to the junction of the second transmission line section and the second stub tuner for connection to the communications equipment operating at the two different frequencies.

3 Claims, 4 Drawing Sheets

```
1.  S1PA    1 0          File Name.S1P
2.  Coax    1 2 0 0      DI=.039 DO=.116      L#0 8.90000 35    ER=2.1    Tand=.0002    RHO=1
3.  Coax    2 22* 0 0    DI=.039 DO=.116      L#0 3.00000 35    ER=2.1    Tand=.0002    RHO=1
4.  Coax    2 3 0 0      DI=.039 DO=.116      L#0 12.9000 35    ER=2.1    Tand=.0002    RHO=1
5.  Coax    3 33* 0 0    DI=.039 DO=.116      L#0 3.90000 35    ER=2.1    Tand=.0002    RHO=1
6.  DEF1P   3            NODE1

7.  TERM
8.  Z0=50

9.  OUT
10. NODE1     VSWR1        GR1
11. NODE1     VSWR1        GR2
12. NODE1     S11          SC2

13. FREQ
14. SWEEP     140          450   1

15. GRID
16. RANGE     140          160   5
17. GR1       1            10    1
18. RANGE     400          450   5
19. GR2       1            10    1

20  OPT
21. RANGE     148          152   1
22. NODE1     VSWR1        <1.5
23. RANGE     418          422   1
24. NODE1     VSWR1        <1.5
```

FIG. 5

MULTIPLE STUB TUNER FOR DISGUISED VEHICLE ANTENNA

CROSS REFERENCE TO A RELATED APPLICATION

Applicant hereby claims priority based on U.S. Provisional Patent Application No. 60/193,207 filed Mar. 30, 2000 and entitled "Multiple Stub Tuner For Disguised Vehicle Antenna" which is incorporated herein by reference.

BACKGROUND OF THE INVENTION

This invention relates to the art of antenna systems for broadcast radios and communications equipment located in vehicles, and more particularly to a new and improved disguised antenna system with tuning or matching network.

An important area of use of the present invention is disguised antenna systems for vehicles containing both standard broadcast radios and communications equipment such as transceivers for automatic vehicle location, surveillance, law enforcement and similar functions. By disguised it is meant that the antenna and its mounting to the vehicle maintain the outward visible appearance of a standard radio broadcast antenna so as not to reveal the presence of communications equipment and the like in the vehicle.

A basic disguised antenna system includes a standard broadcast antenna mounted to a vehicle by means of a base, a tuning or matching network for matching the impedance of the broadcast radio and communication equipment such as a transceiver in the vehicle to the antenna on the outside of the vehicle and a broadcast coupler for providing isolation between the broadcast radio and the communications equipment.

SUMMARY OF THE INVENTION

The present invention provides a new and improved tuning or matching network which resonates the original equipment manufacturer's antenna as supplied on the vehicle. The antenna system must not only continue to function as did the unmodified antenna providing normal AM & FM reception, but must also present a low SWR (Standing Wave Ratio) to a transmitting and/or receiving device. In an application involving two separated frequency spectrums, that are separated by several megahertz, a broadband approach that would function in all cases is not likely. The broadband approach would also be more costly. Since the automotive industry produces as many units as it does, cost is a major concern.

In an embodiment of the present invention a dual resonance will be required to achieve the desired results to provide the low SWR to the receiver and transmitter. For example, the receive passband can be located about ten megahertz below the transmit passband or vice versa. Actually, the present invention has been successful for passbands as close as 1–2% or as a remote as about 300% (such as 150 MHz and 450 MHz). All of this must be done while not changing the outward appearance of the original equipment manufacturer's antenna. Since the original equipment manufacturer's antenna is not a resonant length at either passband some form of matching or tuning network must be employed. The foregoing is accomplished according to the present invention by a matching or tuning network including a multiple stub tuner. The matching/tuning network for use with an original manufacturer's antenna and including a multiple stub tuner according to the present invention both tunes the antenna for communications frequencies when combined with a broadcast coupler (which will become part of the tuner section) and separates the broadcast signals from the communications signals.

The following detailed description of the invention, when read in conjunction with the accompanying drawings, is in such full, clear, concise and exact terms as to enable any person skilled in the art to which it pertains, or with which it is most nearly connected, to make and use the invention.

BRIEF DESCRIPTION OF THE DRAWING FIGURES

FIG. 5 is a computer listing for a method further illustrating the present invention.

DETAILED DESCRIPTION OF THE INVENTION

Figure 1:
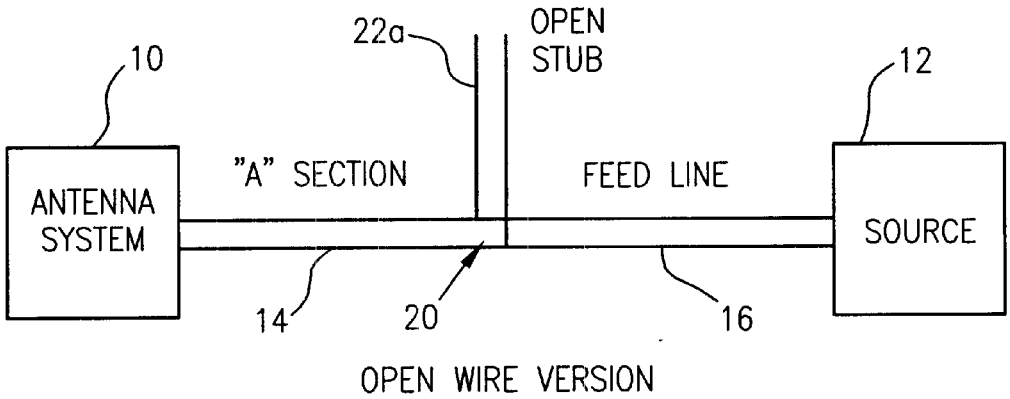
FIG. 1 is a schematic diagram of an open wire version of a basic single stub tuner.
Figure 2:
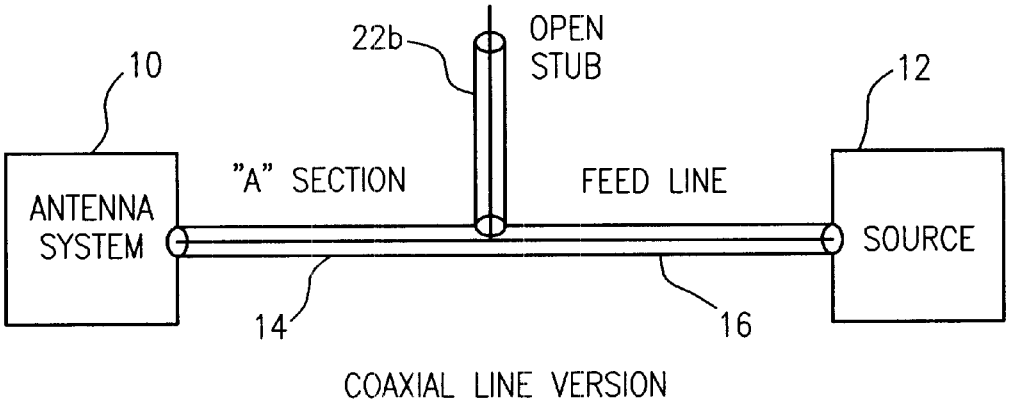
FIG. 2 is a schematic diagram of a coaxial line version of a basic single stub tuner.

The present invention involves a specialized use for a version of a multi stub tuner as used in microwave circuitry. By way of background FIGS. 1 and 2 illustrate a basic single stub tuner, in open wire and coaxial versions, respectively. The stub tuner is located between an antenna 10 and a signal source or transmitter 12. A single stub tuner consists of a transmission line 14 between the antenna system and the transmitter feedline 16, hereafter called the "A Section." A junction 20 is defined between the feedline 16 and the transmission line 14, and this junction is hereafter called the "Stub Junction." At the stub injunction 20 is also connected a piece of feedline 22, hereafter referred to as "The Stub." The stub can either be open 22*a* as shown in FIG. 1 (the not connected end un-terminated), or closed 22*b* as shown in FIG. 2 (the un-terminated end shorted). An open stub is employed in arrangements where the broadcast band is to be passed. In other arrangements where the broadcast band is not of interest a shorted stub can be employed. In either case there is no other connection made to this end of the stub. In the application of interest herein described the transmission line sections will be made of coaxial cable instead of open wire feedline. This is done for several reasons. First, the communication system in which the device is used is coaxial in nature. Second, in the automotive environment where this particular device is to be mainly used, there is an abundance of electrical noise. The use of coaxial transmission lines rejects spurious noise better than open wire lines.

Figure 3:
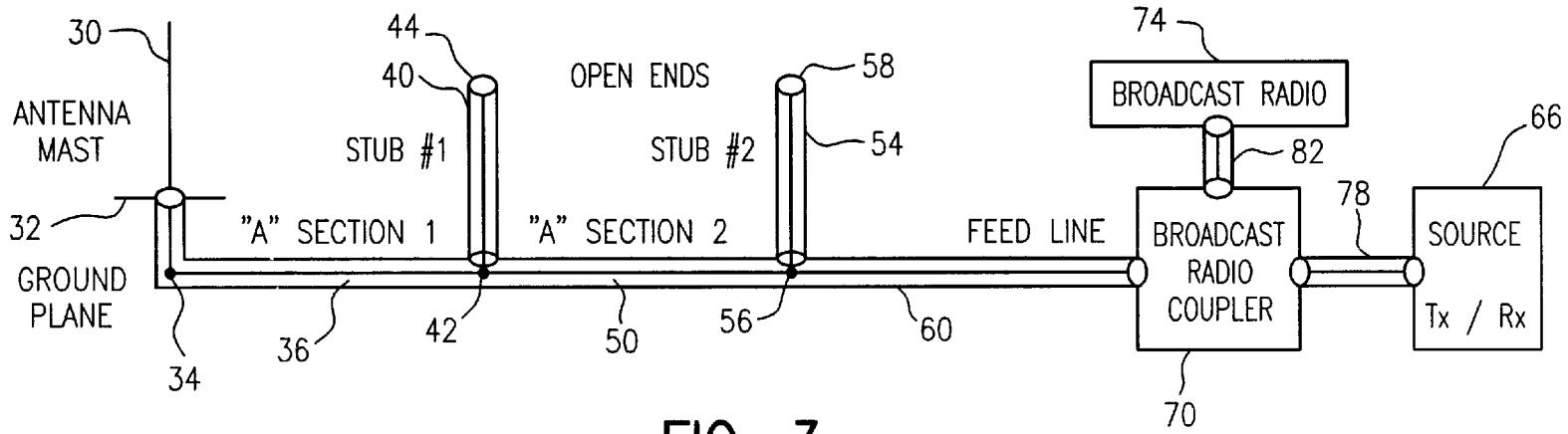
FIG. 3 is a schematic diagram of a multiple stub tuner for use with an antenna according to the present invention.

The matching or tuning network including a multiple stub tuner according to the present invention is illustrated in FIG. 3. The main and most unique feature of the arrangement of FIG. 3 is the use of a multiple stub tuner to resonate the original equipment manufacturer's antenna as supplied on the vehicle. The multiple stub tuner is provided for the existing OEM vehicle antenna with no physical modifications being made to the antenna mast, the antenna base or the antenna feed connection. The antenna system must not only continue to function as did the unmodified OEM antenna providing normal AM & FM reception, but must also present a low SWR (Standing Wave Ratio) to a transmitting and receiving device. Since this application involves two separated frequency spectrums, that are separated by several megahertz, a broadband approach that would function in all cases is not likely. The broadband approach would also be more costly. Since the automotive industry produces as many units as it does, cost is a major concern.

In this particular embodiment a dual resonance will be required to achieve the desired results to provide the low SWR to the receiver and transmitter. For example, the receive passband can be located about ten megahertz below the transmit passband or vice versa. Actually, the present invention has been successful for passbands as close as 1–2% or as remote as about 300% (such as 150 MHz and 450 MHz). All of this must be done while not changing the outward appearance of the original equipment manufacturer's antenna. Since the original equipment manufacturer's antenna is not a resonant length at either passband some form of matching or tuning network must be employed.

The primary purpose of the matching or tuning network of the present invention is to obtain multiple resonances while still maintaining the original or existing physical length of the antenna. Considering the example of a communication device transmitting at 150 MHz and receiving at 140 MHz, with a standard signal stub tuner the SWR at 150 MHz when viewed at 140 MHz would be excessive. However, with the multiple stub tuner of the present invention, the SWR at both those frequencies will have the desirable value of less than 2:1. Furthermore, considering another example where the communication device transmits and receives at more widely spaced frequencies, i.e. at 150 MHz and 450 MHz, what is of concern is only what happens at or near 150 MHz and 450 MHz, and what happens between these frequencies such as at 250 MHz is irrelevant. At such frequencies, i.e. 150 MHz and 450 MHz the multiple stub tuner of the present invention exhibits a desirable SWR of less than 2:1.

FIG. 3 illustrates a two stub version of a tuner according to the present invention. It should be noted that though two A Sections and two Stubs are shown, it may be necessary to use three or more in some cases to achieve the desired results. If necessary, even four stubs can be employed. However, with more than four stubs it is believed that diminishing returns will be encountered. With more than four stubs, the loss of the matching network probably would exceed the gain of the antenna.

Referring now in detail to FIG. 3, a standard OEM vehicle antenna 30 is shown which is mounted in a conventional manner on an exterior surface of a vehicle, the antenna ground plane being designated 32. The junction 34 represents the standard connection to the base of the antenna 30. A first transmission line section 36 is connected at one end thereof to junction 34. Transmission line section 36 is also designated "A Section 1", and in this illustrative embodiment is a length of coaxial cable. At the opposite end of transmission line 36 there is connected one end of a first stub 40, also designated Stub #1. The connection between stub 40 and transmission line section 36 defines a junction 42. In this illustrative embodiment stub 40 is a length of coaxial cable open at the end 44. An open stub is employed because the broadcast band needs to be passed in the illustrative arrangement of FIG. 3. Were that not the case, a shorted stub could be employed.

A second transmission line section 50 is connected at one end to junction 42. Transmission line section 50 is also designated "A Section 2", and in this illustrative embodiment is a length of coaxial cable. At the opposite end of transmission line section 50 there is connected one end of a second stub 54, also designated Stub #2. The connection between transmission line section 50 and stub 54 defines a junction 56. In this illustrative embodiment stub 54 is a length of coaxial cable open at the end 58 for the same reason that stub 40 is an open stub. A feedline 60, also of coaxial cable, is connected at one end to junction 56 and is provided for ultimate connection to a communications device 66 such as a transceiver which operates at two different frequencies, i.e. , device 66 transmits at one frequency and receives at another frequency.

In the illustrative embodiment of FIG. 3 another device 70 is shown which is called the "Broadcast Coupler". The purpose of the broadcast coupler is to separate the AM & FM broadcast signals of the entertainment radio 74 from the communications equipment, also connected to the same antenna 30. The broadcast coupler consists of a high pass and low pass filter. These devices are connected in such a manner as to make the transmitter undetectable while listening to the broadcast radio. This is done to mask the presence of the transmitting device from the vehicle occupants. The reason this is done is to not detract from the broadcast reception, or to prevent the occupants from knowing the transmitter is being activated. This can be for monitoring or tracking the vehicle remotely without the knowledge of the vehicle's occupants. Typical uses would be for tracking overtly or covertly lost or stolen vehicles. However, while the arrangement of the present invention is illustrated for use with a disguised antenna, it can also be used with an overt or un-disguised antenna.

Figure 4:
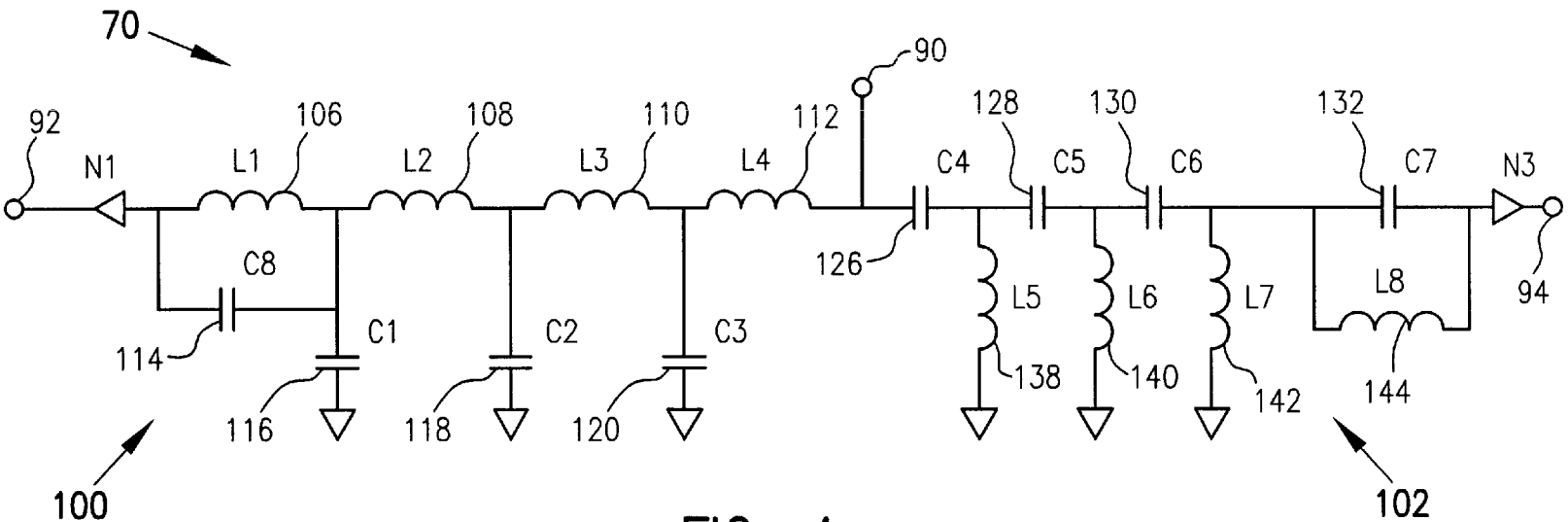
FIG. 4 is a schematic circuit diagram of a broadcast coupler for use in the arrangement of FIG. 3.

As shown in FIG. 3, broadcast coupler 70 is connected to one end of feedline 60, and another feedline section 78, also of coaxial cable, connects broadcast coupler 70 to communications device 66. Another feedline section 82, also of coaxial cable, connects broadcast coupler 70 to broadcast radio 74. Broadcast coupler 70 is shown in FIG. 4 and includes a terminal 90 which is connected to feedline section 60, a terminal 92 which is connected to feedline section 82 and a terminal 94 connected to feedline section 78. Broadcast coupler 70 includes a first filter network 100 which passes to broadcast signals and rejects the communications signals and a second filter network 102 which passes the communications signals and rejects the broadcast signals. Filter network 100 includes a series combination of inductors 106, 108, 110 and 112 connected between terminals 92 and 90. A capacitor 114 is connected in parallel with inductor 106. Capacitor 116 is connected between the junction of inductors 106, 108 and ground, capacitor 118 is connected between the junction of inductors 108, 110 and ground, and capacitor 120 is connected between the junction at inductors 110, 112 and ground. Filter network 102 includes a series combination of capacitors 126, 128, 130 and 132 connected between terminals 90 and 94. Inductor 138 is connected between the junction of capacitors 126, 128 and ground, inductor 140 is connected between the junction of capacitors 128, 130 and ground, and inductor 142 is connected between the junction of capacitors 130, 132 and ground. As inductor 144 is connected in parallel with capacitor 132.

In the multiple stub tuner according to the present invention, the electrical length of each of the "A Section" transmission lines, for example transmission line sections 36 and 50 shown in FIG. 3, is less than $\lambda/2$ at the lowest frequency of operation of the communications device. In the example of FIG. 3 that would be the 150 MHz frequency. The electrical length of each stub, for example stubs 40 and 54, is less than $\lambda/4$ at the lowest frequency of operation of the communications device when the stubs are open, and the electrical length of each stub is between λ/4 and λ/2 at the lowest frequency of operation of the communications device when the stubs are shorted.

By way of example, in an illustrative multiple stub tuner according to the present invention as shown in FIG. 3, wherein communications device 66 transmits and receives on both 150 MHz and 450 MHz frequencies and wherein broadcast radio 74 operates in the standard AM and FM broadcast bands, all of the coaxial cable is RG-303, each stub 40 and 54 is about 3 inches in length and transmission line sections 36 and 50 are about 8.9 inches and 12.5 inches in length, respectively. In broadcast coupler 90, inductors 106, 108, 110 and 112 have approximate magnitudes of 77 nanohenries (NH), 186 NH, 144 NH and 103 NH, respectively. Capacitor 114 has a magnitude of about 9 pico farads (PF), and capacitors 116, 118 and 120 have approximate magnitudes of 30 PF, 39 PF and 45 PF, respectively. Capacitors 126, 128, 130 and 132 have approximate magnitudes of 14 PF, 10 PF, 8 PF and 16 PF, respectively. Inductors 138, 140, 142 and 144 have approximate magnitudes of 34 NH, 37 NH, 49 NH and 273 NH. The foregoing data is for a network connected to a standard vehicle antenna having a length of about 31 inches.

Thus, the matching/tuning network for use with an original manufacturer's antenna and including a multiple stub tuner according to the present invention both tunes the antenna for communications frequencies when combined with a broadcast coupler (which will become part of the tuner section) and separates the broadcast signals from the communication signals. The foregoing is accomplished with the antenna and its mounting to the vehicle maintaining the outward visible appearance of a standard radio broadcast antenna so as not to reveal the presence of communications equipment and the like in the vehicle. In addition, the matching network of the present invention provides a single port, dual frequency antenna which uniquely differs from prior art antennas having high pass/low pass filter networks to tune the antenna to two frequencies and which require two ports. Furthermore, the matching network of the present invention permits closer frequency spacing, i.e. the 150 MHz and 140 MHz example mentioned hereinabove, than what reasonably could be provided by prior art LC filter arrangements. That is because such filters would require high Q to achieve close frequency spacing, and such high Q is difficult to obtain with LC filters. Furthermore, the more L and C introduced to the network, the greater will be the losses.

The matching network of the present invention is further illustrated by the following example which describes a method for determining the lengths of the coaxial "A" sections and the lengths of the stubs. This example will show how the particular illustrative values specified hereinabove for FIG. 3 were obtained. The lengths of the coaxial "A" Sections and Stubs are determined through the use of an automated computer program commercially available from Hewlett Packard EESOF Touchstone version 3.0. The computer program performs the repetitive mathematics and iterative calculations.

Prior to the actual design of the antenna parameters a computer file of the antenna is taken. This file is obtained by using a Hewlett Packard Network Analyzer 8753ET or equivalent. The antenna to be designed is mounted on the fender of the vehicle for which it is being designed. In some cases the vehicle skin involved with the antenna and the surrounding ground plane are used, instead of the whole vehicle. The antenna to be designed is connected at its base to the network analyzer with a calibrated cable. This guarantees the file being used to simulate the antenna in the computer program is as accurate possible. Accuracy at this juncture is the controlling factor in the simulation. The network analyzer is calibrated for the frequency range and connecting cable prior to recording the file. When the file has been generated it is stored on a floppy disk for transfer to the computer system used to run the EESOF Touchstone simulation program. The resulting file contains information on the antenna such as its length, the length/diameter ratio of the mast, the capacity of the base of the antenna and the location of the antenna relative to other parts of the vehicle such as its location in reference to the roofline, the length of the fender on which it is mounted and the distance between the antenna and fender edge.

Figure 6:
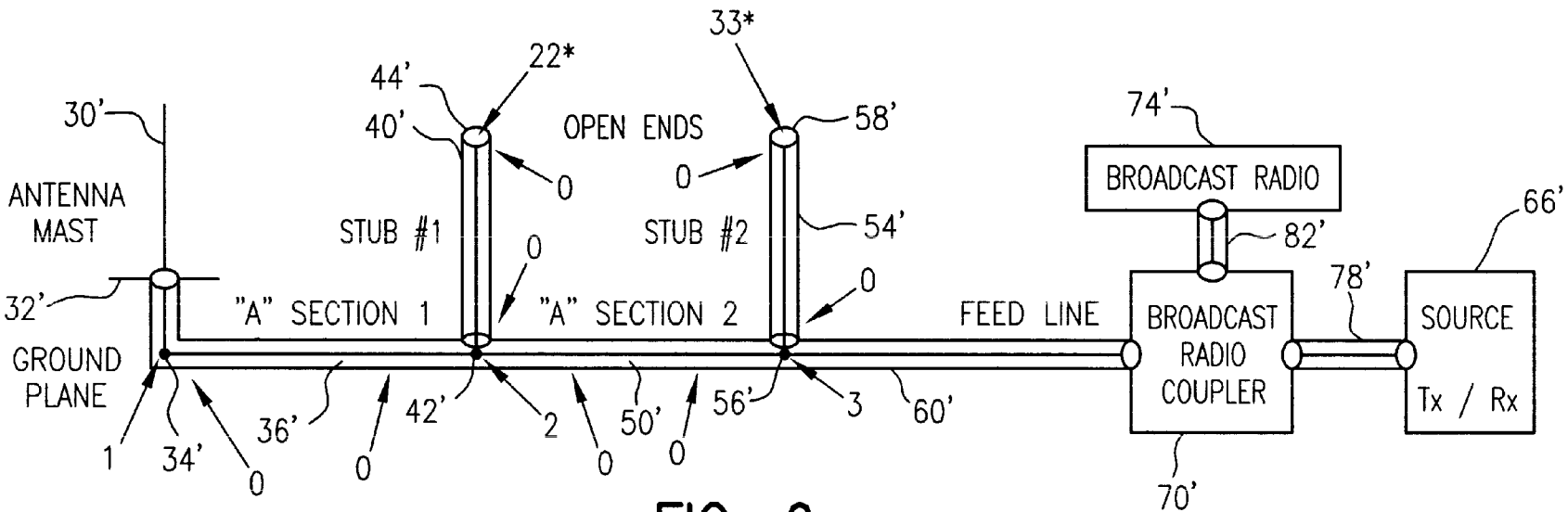
FIG. 6 is a schematic diagram like FIG. 3 and including additional information pertaining to the method of FIG. 5.

The following description will refer to the file listing set forth in FIG. 5. The definitions and terms used in the file or its description are taken from the EESOF Touchstone reference manual. In particular, the description will reference the individual lines of the listing in FIG. 5, i.e. Line #1, Line #2, etc. FIG. 6 is identical to FIG. 3 wherein the identical components have the same reference numerals, but with a prime designation in FIG. 6. The various numbers added in FIG. 6, i.e. 0, 1, 2, 3 identify the network nodes referred to in the listing of FIG. 5, and 22*, 33* refer to the ends of the stubs. A line by line description of the FIG. 5 listing now follows.

Line #1 is the file statement of the computer file generated on antenna 30' by the network analyzer.

S1PA defines the file that follows as the number 1 single port file.

1 0 Defines the nodal values of that file. Node 1 is the connection to the base of antenna 30'. Zero is always ground.

The FileName.S1P Identifies the file to be used for the simulation.

Line #2 Defines the first coaxial section (the first "A" Section 36').

COAX defines the element as a coaxial section.

1 2 0 0 Are the nodal numbers for the coax line. 1 and 2 are the ends of the center conductor. The two zeros represent the shield terminals of the coaxial line, both grounded.

Any digits can be assigned to the nodal points except for ground which must (by convention) be zero.

The digits of the same value are connected together.

Digits that only appear once are nodal points that do not connect to any other point in the circuit, the open end of the coaxial stubs.

DI Represents the coax cable center conductor outside diameter.

DO Represents the coax cable outside the shield inside diameter.

L defines the coax length

The # Sign indicates the value will be variable, with a upper lower limit (0) and a upper limit of 35.

The number between the two limits 8.90000 represents the result of the simulation. Normally this value is set approximately half way between the limits for a starting value.

ER Represents the dielectric constant of the coaxial cable being simulated.

TAND Represents the Loss Tangent of the coaxial cable dielectric.

RHO represents the relative conductivity of the coaxial cable conductors.

For copper the value is 1.

Line #3 is for the first stub 40' and has the same description as line #2 except the node numbers and length change, the nodal number change is done to show the proper connection of the network being simulated. Note the 22* is not connected to any other point in the circuit, this indicates the un-terminated (open end) of the stub.

Line #4 and Line#5 are the second "A" Section 50' and Stub 54' in this simulation. Though the number of "A" Sections and Stubs is not limited to two, this simulation uses only two.

Line #6 defines the name of the over all network being simulated, this being required by the computer program protocol.

Line #7 delineates the Termination block, again for computer program protocol.

Line #8 Z0=50 indicates that the terminating impedance is 50 ohms for this simulation.

Line #9 delineates the output, again for purposes of computer program protocol.

Line #10 says the NODE1 VSWR1 parameter will be observed on the Grid 1 of the computer screen.

Line #11 says the NODE1 VSWR1 parameter will also be observed on Grid 2.

Line #12 says the NODE1 Smith Chart (S11) will be viewed on the S2 Chart on the computer screen.

Line #13 defines Sweep Parameters.

Line #14 defines the overall sweep range for the simulation from a lower frequency limit of 150 MHz to an upper frequency limit of 450 MHz. The 1 indicates that calculations will be made at a spacing of 1 MHz across the sweep range.

Line #15 defines the screen grid specifications.

Line #16 sets the frequency range for Grid 1

Low frequency range 140 MHz

High frequency range 160 MHz

Frequency grid spacing to 5 MHz.

Line #17 sets the VSWR1 amplititude grid scale 1 sets the low level of the grid to an SWR value of 1:1

10 sets the high level of the grid to an SWR value of 10:1

The second 1 defines the grid SWR spacing of 1.

Line #18 sets a second frequency range for grid 2.

The frequency range is 400 to 450 MHz, with a resolution of 5 MHz.

Line #19 Sets the SWR range for grid 2.

Both will show different frequency ranges for VSWR1.

Line #20 delineates the optimization block.

Line #21 Defines the first optimization frequency range as 148 to 152 MHz.

The spacing of the optimization points is 1 MHz.

Line #22 determines the parameter to be optimized and the goal VSWR1 for the optimization is set to 1.5:1 or better across the frequency range of line 21.

Line #23 and 24 sets up a second range of optimizations.

The computer simulation program will alter the values of the variables in lines #1 through line #6 within the ranges set for the variables in lines #2 through line #5. When the simulation reaches the criteria set in the optimization section Lines #20 through #24 an appropriate indication is given. If the program cannot reach the desired performance the program will continue to run until stopped by the operator or a preset number of calculations are finished. After simulation the simulated circuit values are built into a prototype. The stub lengths are normally built 0.1 or 0.2 inches to long to permit for a final adjustment at the time of final test.

It is therefore apparent that the present invention accomplishes its intended objects. While an embodiment of the present invention has been described in detail, that is for the purpose of illustration, not limitation.

What is claimed is:

1. A matching network for coupling an OEM vehicle antenna comprising antenna mast and base to communications equipment operating at two different frequencies, said network comprising:

a) a first transmission line section connected at one end to said antenna;

b) a first stub tuner connected to the opposite end of said first transmission line section;

c) a second transmission line section connected at one end to the junction of said first transmission line section and said first stub tuner;

d) a second stub tuner connected to the opposite end of said second transmission line section;

e) and a feedline connected to the junction of said second transmission line section and said second stub tuner for connection to communications equipment operating at two different frequencies;

f) the electrical length of each of said first and second transmission line sections is less than one-half wavelength at the lowest operating frequency of the communications equipment and the electrical length of each of said first and second stub tuners is less than one-quarter wavelength at the lowest operating frequency of the communications equipment when the stub tuners have open terminations and between one-quarter wavelength and one-half wavelength at the lowest operating frequency of the communications equipment when the stubs have closed termination; and g) so that operation of the communications equipment at the two frequencies is allowed without any physical modification to the antenna mast and base.

2. The matching network according to claim 1, further including a broadcast coupler connected in said feedline for connection to a standard broadcast receiver, said broadcast coupler having a first filter network for passing the broadcast receiver signals and rejecting the communications equipment signals and a second filter network for passing the communications equipment signals and rejecting the broadcast receiver signals.

3. A method for constructing a matching network for coupling an existing OEM vehicle antenna to communications equipment operating at two different frequencies, the network comprising a first transmission line section connected at one end to the antenna, a first stub tuner connected to the opposite end of the first transmission line section, a second transmission line section connected at one end to the junction of the first transmission line section and the first stub tuner, and a second stub tuner connected to the opposite end of the second transmission line section, the junction of the second transmission line section and the second stub tuner adapted for connection to communications equipment operating at two different frequencies, the method comprising:

A) utilizing a network analyzer connected to the antenna to provide an information record of antenna parameters;

B) specifying initial values for the electrical lengths of each of the first and second transmission line sections which are less than one-half wavelength at the lowest operating frequency of the communications equipment and initial values for the electrical lengths of each of the stub tuners which are less than one-quarter wavelength at the lowest operating frequency of the communications equipment when the stub tuners have open terminations and between one-quarter wavelength and one-half wavelength at the lowest operating frequency of the communications equipment when the stub tuners have closed terminations;

C) specifying a desired standing wave ratio at the antenna for each of the two operating frequencies of the communications equipment; and D) utilizing the information record of antenna parameters and the desired standing wave ratio to adjust the initial values of the electrical lengths to achieve the desired standing wave ratio;

E) so that the matching network allows operation of the communications equipment at the two frequencies without any physical modification of the antenna.

* * * * *